United States Patent [19]

King

[11] Patent Number: 4,895,230

[45] Date of Patent: Jan. 23, 1990

[54] COLLAPSIBLE SOFTSIDE LUGGAGE CASE WITH SELF-ERECTING FEATURE

[75] Inventor: William L. King, Denver, Colo.

[73] Assignee: Samsonite Corporation, Denver, Colo.

[21] Appl. No.: 247,800

[22] Filed: Sep. 22, 1988

[51] Int. Cl.[4] ..... A45G 7/00

[52] U.S. Cl. ..... 190/107; 190/103

[58] Field of Search ..... 190/103–105, 190/107

[56] References Cited

U.S. PATENT DOCUMENTS

| | | | |
|---|---|---|---|
| D. 285,748 | 9/1986 | Feinberg et al. | 190/103 |
| 1,040,300 | 10/1912 | Fitzgerald . | |
| 1,513,909 | 11/1924 | Hunter | 190/103 |
| 2,249,905 | 7/1941 | Lifton | 190/103 |
| 2,533,850 | 12/1950 | Syracuse . | |
| 2,718,943 | 9/1955 | Braverman . | |
| 3,023,867 | 3/1962 | Kotkins . | |
| 3,071,220 | 1/1963 | O'Neil . | |
| 4,773,515 | 9/1988 | Kotkins, Jr. | 190/103 |

FOREIGN PATENT DOCUMENTS

| | | | |
|---|---|---|---|
| 39220 | 5/1965 | Fed. Rep. of Germany | 190/107 |
| 1069164 | 2/1954 | France | 190/107 |
| 580953 | 9/1946 | United Kingdom | 190/107 |

*Primary Examiner*—William Price
*Attorney, Agent, or Firm*—Gregory W. O'Connor

[57] ABSTRACT

Luggage cases of the softside construction which are capable of being collapsed when not in use are known. However, these past constructions are cumbersome, heavy, or comprise a number of parts which must be assembled by the retailer in order to display the case in its erected condition or must be erected by the consumer before the case can be used for travel, packing, etc. The disclosed luggage case comprises a 6-sided case of the duffel type which includes a bottom board, a front batten stiffening the front panel, and a back batten stiffening the back panel, and including at least perimeter stiffening means, preferably a stiffening wire or coil wire around each end panel. The bottom board is releasable to permit it to be placed in parallel with the stiffened front panel. The packing door carries the stiffening batten for the back panel, and this permits the batten to be moved parallel to the bottom board and front batten. Then the stiffening means for the end panels may be hinged about their intersection with the front panel in order to bring all of the stiffening members parallel to and juxtapositioned with one another for compact storage.

10 Claims, 2 Drawing Sheets

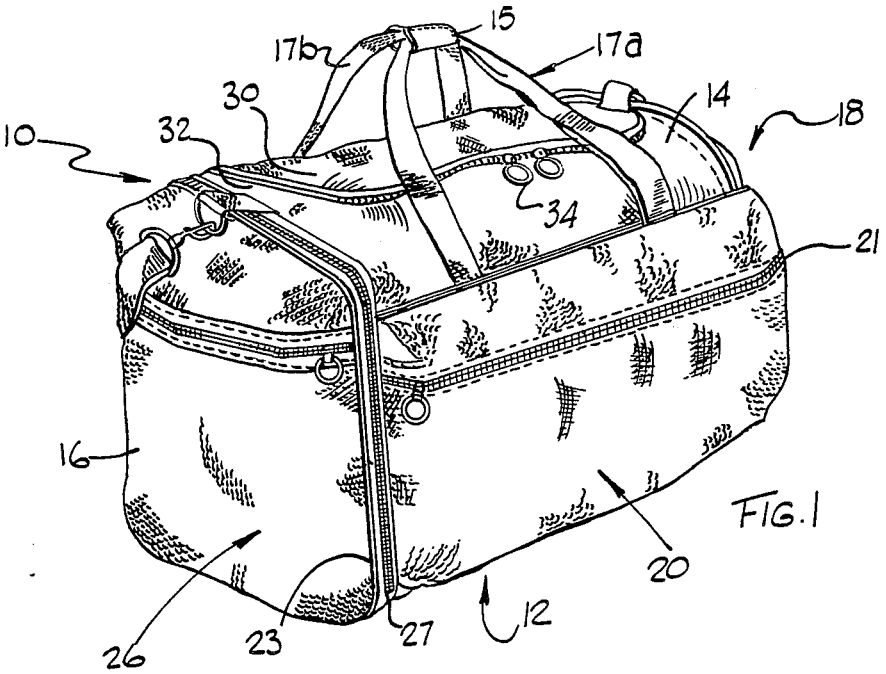
FIG. 1
FIG. 2
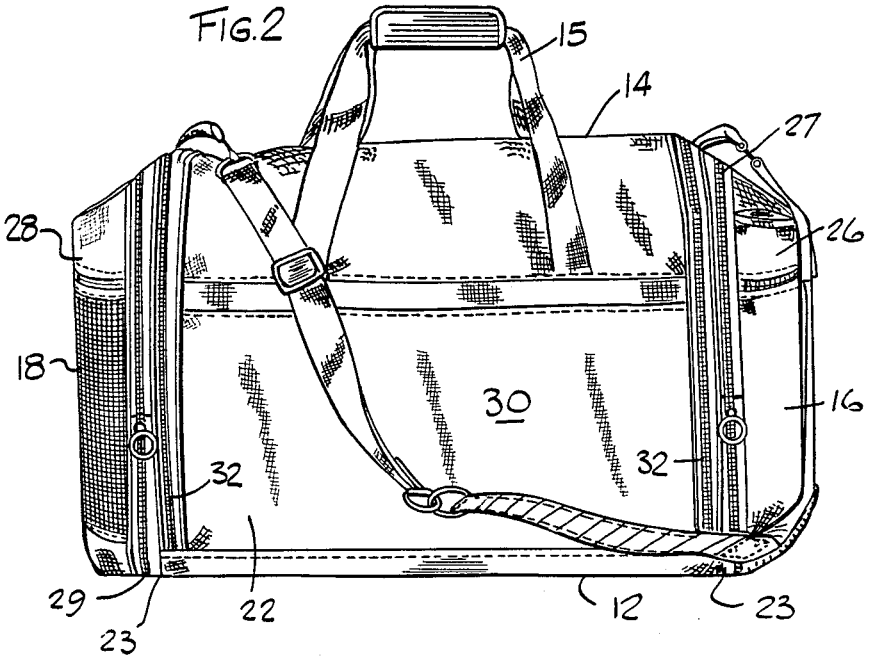

COLLAPSIBLE SOFTSIDE LUGGAGE CASE WITH SELF-ERECTING FEATURE

CROSS REFERENCE TO RELATED APPLICATION

This application is related to the subject matter of pending design application Ser. No. 101,331, William King, Inventor, assigned to Samsonite Corporation.

BACKGROUND OF THE INVENTION

1. Field of the Invention. This invention relates to luggage cases constructed generally of cloth covered or cloth defined panels. This type of luggage is generally known as "softside" luggage. More particularly, this invention is related to softside luggage which is capable of being broken down or collapsed, either for the purpose of reducing shipping volume when the luggage piece is traveling from the manufacturer/distributor to the retailer, or for easy storage by the consumer when the luggage case is not in use. The preferred embodiment of this invention is related to that type of luggage known as a duffel bag.

2. Description of the Related Art, Including Information Disclosed Under 37 C.F.R. 1.97–1.99. Collapsible softside luggage is generally known. For example, a folding hatbox is shown in U.S. Pat. No. 1,040,300. In that disclosure, a generally cube shaped construction comprises fabric panels which are each reinforced or stiffened with a plurality of whalebone ribs. Some of these panels are permanently hinged together; others are releasably attached to one another through the use of snap fasteners or the like. In operation, the panels each may be moved into the same plane (see FIG. 2) and the entire construction rolled to form a compact package as shown in FIG. 3. When assembled, the snap fasteners connect each panel with its adjacent panel, forming the useful hatbox.

Another example of a collapsible luggage is shown in U.K. Patent Specification 580,953, dated Sept. 25, 1946. In this disclosure, a luggage case includes a zippered access opening or lid 26. This lid is made of canvas, limp leather or other flexible material. The other components of the case are stiffened throughout by various panels secured to the skin or lining of these flexible materials. The end panels 17 are stiffened by two separate rectangular stiffening panels 18. The bottom panel 25 is stiffened with four triangular panels and two trapezoid shaped panels. Each of these stiffening panels are hinged together by the skin and lining materials. This construction allows the case to be collapsed so that the ends 17 and bottom 25 are folded between the sides 12 and 13, and the flexible lid can be wrapped around the thus collapsed case.

U.S. Pat. No. 2,718,943 discloses another solution to making a collapsible luggage which includes a frame-like structure shown in FIG. 3. The frame includes perimeter wire stiffeners 41 and 42 which are hingedly attached at opposite ends of the bottom board 38. These frames 41 and 42 are releasably attached to the top board 36 in a manner to permit them to be swung inwardly and lay approximately parallel to the bottom board. Thus deployed, the frames permit the upper board 36 and the fabric construction it normally supports to collapse downwardly to make a fairly compact structure as shown in FIG. 8.

U.S. Pat. No. 3,071,220 shows another collapsible case construction. Interiorly disposed end wall panels, shown as construction 22, are normally disposed immediately inside the end covering sheets 21. The upper and lower edges of these panels 22 normally bear firmly against the inner coverings 12 and 13 of the reinforced top and bottom members which comprise the upper and lower panels of the finished construction. The panels 22 may be removed to permit the case to collapse into a more compact package.

U.S. Pat. No. 2,533,850 shows a handbag having end panels which consist of zippered pockets. As shown in FIG. 3 thereof, these end pockets are sized to carry nursing bottles.

U.S. Pat. No. 3,023,867 shows a luggage case with a bale handle construction which comprises a pair of handle loops 55 and 55*x* attached to the front and back panels of the luggage case. This patent further discloses an access means comprising a zippered door panel, one of the handle loops being carried by the door panel, and the door panel being attached to the remainder of the case by a single zipper track which extends around the perimeter of the access panel.

However, none of these prior art collapsible luggage constructions provides a luggage case which can be shipped in a collapsed and thus compact construction in a manner so that during shipping and erection the major panels are not unacceptably crushed or wrinkled, yet can be easily erected by the retailer. Nor, do these prior art collapsible luggage pieces disclose a construction which permits the consumer to use the case in a manner that permits access to the interior but this access does not result in unintentional collapsing of the luggage case, that is, the luggage case remains erect for easy packing, yet the consumer without disassembly or removal of parts, can collapse the luggage piece easily. Nor, do the prior art constructions retain the reduced weight and expansible characteristics of softside luggage while imparting to that softside luggage an overall structured operation without adding weight which is characteristic of structured softside luggage.

SUMMARY OF THE INVENTION

Accordingly, this invention concerns a collapsible softside luggage case comprising a plurality of panels which are connected together at their intersections. These panels include a bottom panel on which the luggage case normally rests when it is in the erected condition; this bottom panel includes a means for stiffening the bottom panel when the luggage piece is in the erected condition. Also included are opposed front and back panels connected along their lower edges to the bottom panel, and side or end panels normally connected to the opposed front and back panels and the bottom panel. One of the opposed front or back panels includes either an access means for the interior of the luggage piece. The end panels include at least a stiffening means around the periphery thereof. There are means provided for hingedly attaching the panels together to permit these end panels to be folded about their intersections between the other one of the opposed front and back panels to place these end panels parallel to the back panel. Also included are means interconnecting the bottom board or the like to place the bottom board parallel with the end panels when the end panels are folded about their intersections. In this way, the various stiffening means may be folded towards one another to collapse the luggage piece when not in use.

The bottom board may be releasably attached to the end panels either by way of being hingedly attached along one edge to the bottom panel, or the bottom board may be attached to the bottom panel and the bottom panel itself may be releasably attached to the end panels, preferably by a zipper or the like.

Also provided is a luggage case whose end panels include pockets, each pocket having access to the interior from the outside and preferably comprising the entire lateral extent of the end panel.

The front panel and back panel each preferably include a stiffening means comprising a stiffening batten along or proximate to the intersection of the top panel and each of the front and back panels. Carrying means, preferably comprising a pair of handle loops, is provided. One of the handle loops is fixedly attached to one of the stiffening battens.

BRIEF DESCRIPTION OF THE DRAWINGS

In the drawings, FIG. 1 shows a perspective view of a luggage case, specifically a duffel, according to the instant invention.

FIG. 2 shows a view of the backside of the luggage case of FIG. 1.

DESCRIPTION OF THE PREFERRED EMBODIMENT

Figure 3:
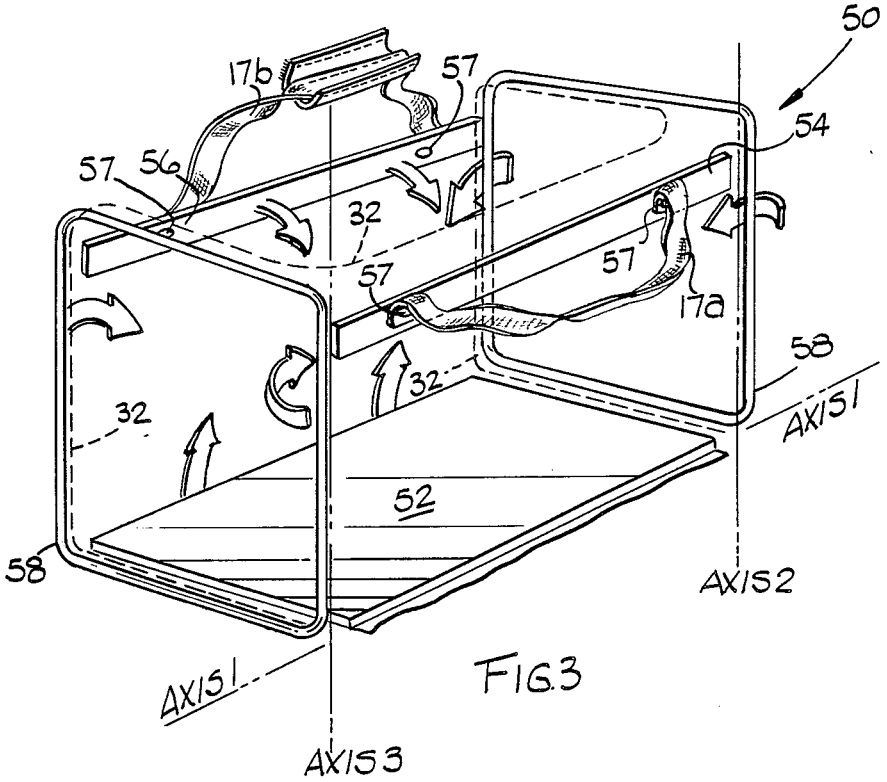
FIG. 3 shows the skeletal stiffening structure, which forms a part of the construction of the preferred embodiment.

Referring first to FIGS. 1 and 2, a luggage case 10 is shown, which generally is in the shape of a parallelopiped, whose six sides are composed of six panels: a bottom panel 12 on which the luggage case, in its erected condition as shown, normally sets; a top panel 14 opposite the bottom panel; a first end panel 16 and opposite it a second end panel 18, a front panel 20 and opposite it a back panel 22. At least one carrying means 15 is included. In the preferred embodiment this is composed of a pair of handle loops, handle loop 17A being attached at the upper edge of the front panel 20, and handle loop 17B being attached at the upper edge of the back panel 22. Means for accessing the interior of the luggage case is provided comprising access door 30. This access door extends preferably to and beyond the center line of the top panel 14, and also comprises the majority of rear panel 22 (see FIG. 2). The access door 30 is attached to the case via a continuous zipper track 32, which continues around its periphery, specifically up a path approximate the intersection of the back panel and the second end panel 18, across the intersection of end panel 18 and the top panel 14, across the top panel and down the other side near the intersection of end panel 16 with the top panel and back panels in a symmetrical manner. The zipper track 32 is provided with a pair of oppositely facing zipper slides 34 to permit the user to open all or selected portions of the access door 30. In the preferred embodiment, the zipper track 32 terminates at the intersection of the back panel 22 and the bottom panel 12. However, as will be set forth in greater detail with reference to FIGS. 3 and 4, the zipper track 32 can continue along the intersections between the end panels 16 and 18 and the bottom panel 12 to permit the bottom panel with its stiffening member to be folded about its intersection with the front panel 20 when collapsing the luggage case for shipping or storage.

The first and second end panels include respectively a first end pocket 26 and second pocket 28. These end pockets extend the entire extent of the end panels, i.e., they are the end panels themselves. Each of the end panels and their respective pockets are provided with expansion zippers 27 and 29. These expansion zippers are of known type, basically operating to collapse or deploy a underlying gusset as detailed in U.S. Pat. No. 3,443,671.

The front panel 20 is usually defined by an insignia, pocket or other aesthetic or functional feature. In the preferred embodiment, the front panel includes a large gusseted pocket 21. The front panel is usually that which is prominently displayed by the retail store. It should convey the function and pleasing aesthetic of the case to the prospective purchaser. Accordingly, this portion of the construction, along with the other major aesthetic aspects of the bag, should not be adversely affected by the shipping in the collapsed condition. While a gusseted pocket is shown, the front panel could also include a series of such pockets, a panel, a place for the name of the manufacturer or initials of the owner of the luggage case.

Figure 4:
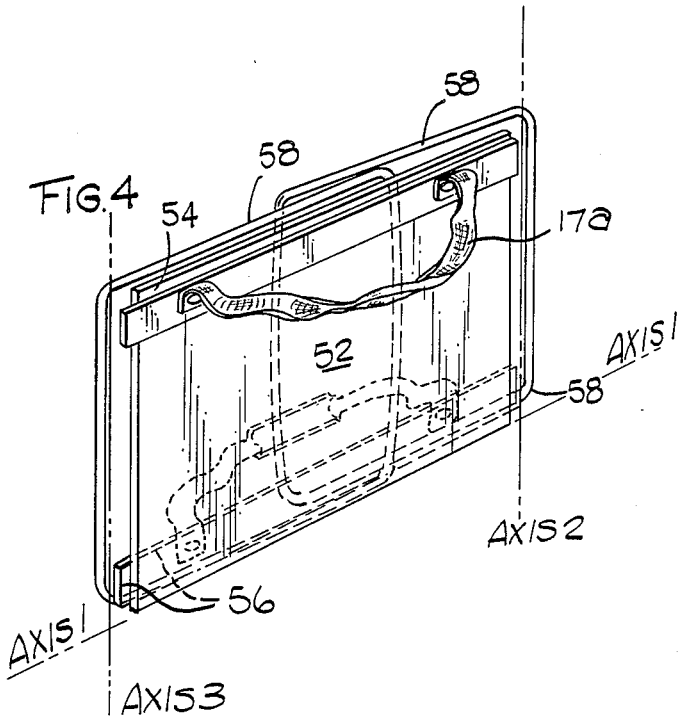
FIG. 4 shows the construction of FIG. 3 illustrating the position of the various parts when the luggage case is in the collapsed condition.

Unlike some softside luggage, the subject invention includes a stiffening means built into the luggage case, and preferably into most of the six panels making up the case, to provide structure thereto. This structural aspect is used not only to properly erect and display the case as is dictated by good merchandising practice, but also to permit the user to place items or remove items therefrom easily. However, this stiffening means should not be readily apparent, especially if the luggage case of which it forms a part is intended to have a casual or sporty look. In the preferred embodiment, then, the stiffening means comprises a skeleton like structure which is shown in FIGS. 3 and 4. Applicant has taken license to remove the generally non-structural cloth covering of the luggage case to show this skeleton 50 to best advantage. The skeleton 50 comprises a number of parts; each part is attached to its associated panel. The bottom board 52 comprises a fabric covered composition material, and is normally parallel to or a part of the bottom panel 12. Attached to each of the end panels 16 and 18 is an end panel stiffening means, preferably comprising a perimeter wire 58 and 58. The perimeter wire could either be a hardened steel wire or a coil wire of known type. This stiffening wire is preferably contained in a perimeter beading 23 around each of the end panels and approximate to the zipper track 32, at least on the back panel 22.

The front panel 20 includes a stiffening element 54, a batten of resilient plastic material such as polyethylene or polypropylene. The batten 54 is sewn into the front panel approximate to the upper edge or intersection between the front panel and the top panel. In like manner, the rear panel 22 includes a similarly constructed and positioned batten 56. As the access door 30 comprises the bulk of rear panel 22, the batten 56 is carried by that access door 30. These batten 54 and 56 not only provide stiffening for holding the luggage case erect, but also can be used to distribute some of the stress associated with carrying handle 15. To this end, attachment means 57, preferably rivets, are passed through each of the front and rear panels and their associated battens 54 and 56, and attach the respective handle loops 17A and 17B.

The skeleton 50 is integrated into the overall bag as follows. The bottom board 52, depending on the extent at which the zipper track 32 releasably extends to releasably attach the bottom panel to the end panels, is either built into the bottom panel or is itself hingedly but permanently attached to the bottom panel along access 1 (FIG. 3). Such hinged attachment, as is typical in luggage construction, is done by sewing an extension of the fabric covering the bottom board into the seam at the intersection of the bottom panel and the front or end panel. The stiffening batten 54 is permanently attached to the front panel, which is in turn closely attached to the stiffening perimeter wires 58. This stiffening batten not only holds the front panel out and keeps it from collapsing, but, in combination with the bottom board 52, it also holds the end panels outward during display and use.

Since the stiffening batten 56, as stated previously, is permanently attached to the access door 30, it can be moved in the manner, as will be set forth, relative to the stiffened end panels and the first batten 54. Starting with the luggage case in the erected condition as shown in FIG. 1 (and its skeleton structure 50, as shown in FIG. 3), the process of collapsing the luggage piece will be set forth. First the zipper sliders 34 are operated to separate the door panel 30 (and thus most of the rear panel 22) from the rest of the case. The bottom board 52 is raised about its hinged attachment along axis 1 to bring it in parallel configuration with the front panel and its stiffening batten 54. Door panel 30, with its batten, is folded inwardly to place the batten 56 parallel to and adjacent with the raised bottom board, preferably along the lower most edge near axis 1. Now, each of the end panels 16 and 18 are hinged about its intersection with the front panel (shown as axes 2 and 3 respectively) to bring the stiffening wires 58 and 58 generally parallel with one another, in overlapping condition, and in a generally parallel plane with the rest of the stiffening members of the skeleton 50. The resulting collapsed bag takes up very little space. However, in contrast with other constructions, the major panels, specifically the front panel and the end panels, are not unduly crushed in the process.

Alternatively, the bottom board 52 could be permanently attached to the bottom panel 12 and the zipper track 32 continue along the intersection of the bottom panel 12 and the end panels 16 and 18. This is shown graphically by dotted line 32 in FIG. 3. In this situation, the zipper tracks are unzipped completely, freeing the bottom board, together with its integral stiffening board 52, to permit it to be hinged about axis 1. The resulting collapsed construction would be identical with that shown in FIG. 4.

The resulting construction is aesthetically pleasing, is easily operated by either the consumer or the retailer, and has the advantages of an unstructured, thus collapsible, softside luggage (casual look, compact storage capability, etc.) with the advantages of a more structured formal case (ability to stay erect for use or be erected for display).

I claim:

1. A collapsible soft luggage case comprising a plurality of panels which are connected together at the intersections thereof, said panels including a bottom panel on which a luggage case rests when in an erected condition, said bottom panel including means for stiffening said bottom panel when said luggage case is in the erected condition, opposed front and back panels connected along their lower edges to opposed edges of said bottom panel, opposed end panels normally connected to said opposed front and back panels and said bottom panel; at least a first one of said opposed front and back panels including means for selectively accessing the interior of said luggage case when said luggage case is in the erected condition, said end panels including means around the periphery thereof for stiffening said end panels, means for hingedly attaching said panels together to permit said end panels to be folded about their intersections between a second one of said opposed front and back panels to place said end panels generally parallel to said second one of said front and back panels, and means interconnecting said means for stiffening said bottom panel with said second one of said front and back panels to place said means for stiffening said bottom panel generally parallel with said second one of said front and back panels, whereby said means for stiffening said end panels may be folded towards one another to collapse said luggage case when not in use.

2. A luggage case as set forth in claim 1 wherein said bottom panel is releasably attached to said end panels.

3. A luggage case as set forth in claim 1 wherein at least one of said end panels includes a pocket, said pocket having access to the interior thereof from the outside of said end panel.

4. A luggage case as set forth in claim 1 further including a top panel, said top panel including means for accessing the interior of said luggage case, said means for accessing comprising an extension of said means for accessing on said front panel.

5. A luggage case as set forth in claim 2 wherein said means for accessing includes a single zipper track, said single zipper track extending from the intersection between said bottom panel and a first of said end panels around the intersection thereof, said zipper track extending around the intersection between said front panel and said end panel, the intersection between the second end panel and said bottom panel, and the intersection of said second end panel and said front panel.

6. A luggage case as set forth in claim 1 wherein said stiffening means comprises a stiffening panel separable from said bottom panel and hingedly attached approximate the intersection of said back panel and said bottom panel, whereby said stiffening panel can be hingedly moved from a position adjacent said bottom panel to a position adjacent said back panel when said luggage case is in a collapsed condition.

7. A luggage case as set forth in claim 1 wherein said back panel includes a stiffening batten which extends laterally from the intersection of a first one of said end panels along said back panel to the intersection of said back panel and a second of said end panels.

8. A luggage case as set forth in claim 7 wherein said stiffening batten is located adjacent the edge of said back panel opposite from and along a line parallel to said bottom panel.

9. A luggage case as set forth in claim 1 wherein said means for accessing includes a single zipper track extending from the intersection of said bottom panel, a first one of said end panels and said front panel, and along the intersection of said first one of said end panels and said front panel, continuing across the top of said bag from said first one of said end panels to a second one of said end panels, and continuing around the intersection of said second one of said end panels and said front panel, terminating approximate to the intersection of said bottom panel, said front panel, and said second one of said end panels.

10. A luggage case set forth in claim 9 wherein said single zipper track extends from between said first one of said end panels and second one of said end panels in a line along said top panel approximately equidistant between said front panel and said back panel, said zipper track having a pair of oppositely facing zipper sliders thereon, whereby a user of said luggage case may position the zipper sliders such that the upper portion of said access means can be operated to open only a portion of said upper panel, and whereby said user of said luggage case may optionally operate said sliders to open both a portion of said upper panel and said front panel thereof.

* * * * *